United States Patent [19]

Schiefer

[11] 4,367,871

[45] Jan. 11, 1983

[54] ARTICULABLE TRAINING DEVICE FOR RACQUET SPORTS AND THE LIKE

[76] Inventor: William E. Schiefer, 305 Walnut St., San Diego, Calif. 92103

[21] Appl. No.: 172,178

[22] Filed: Jul. 25, 1980

[51] Int. Cl.[3] ..... A63B 69/38

[52] U.S. Cl. ..... 273/29 A; 273/193 B; 273/73 J; 403/294

[58] Field of Search ..... 273/29 A, 35 R, 183 D, 273/186 R, 186 A, 193 R, 193 B, 93 A, 73 R; 16/DIG. 13; 46/289, 16, 25, 29; 403/2, 76, 78, 79, 11, 292, 294, 298, 3, 291, 220

[56] References Cited

U.S. PATENT DOCUMENTS

| | | | |
|---|---|---|---|
| 497,915 | 5/1893 | Fulghum et al. | 403/294 |
| 648,256 | 4/1900 | Hartley | 403/220 |
| 1,428,015 | 9/1922 | Dienner | 273/193 B |
| 1,529,305 | 3/1925 | Gatke | 273/193 B |
| 3,033,575 | 5/1962 | Haus | 273/193 B |
| 3,170,690 | 2/1965 | Goranson | 273/193 B |
| 3,679,205 | 7/1972 | Finkle | 273/193 B |
| 3,912,404 | 10/1975 | Kall | 403/11 |
| 3,912,405 | 10/1975 | Kall | 273/193 B |

*Primary Examiner*—Richard C. Pinkham

*Assistant Examiner*—T. Brown

*Attorney, Agent, or Firm*—Bruno J. Verbeck; Michael L. Slonecker

[57] ABSTRACT

An articulable training device, particularly adapted for continuously reinforcing proper stroking or serving techniques necessary to successfully play various racquet sports such as tennis, is disclosed herein and comprises a tennis racquet having an elongated handle member and a member which includes a ball rebounding surface or net face at one end thereof. The device for connecting said handle and said member having a ball rebounding surface for free relative pivotal movement about an axis transverse to the longitudinal dimension of said handle and generally parallel with said ball rebounding surface. Further included are means for limiting the range of relative pivotal movement of said members to thereby minimize the likelihood of accidental injury to the player using the racquet. Finally, means for rigidly connecting in substantially longitudinal alignment said handle and said member, whereby to prevent relative pivotal movement, are disclosed which enables adaptation of the device for playing various sports in a conventional manner.

3 Claims, 9 Drawing Figures

ARTICULABLE TRAINING DEVICE FOR RACQUET SPORTS AND THE LIKE

BACKGROUND OF THE INVENTION

The present invention relates to a device adaptable as a training aid for various racquet sports or the like, and more particularly to an improved tennis racquet construction designed to continuously reinforce proper service and stroking techniques.

In order to master the fundamental techniques necessary to successfully play the game of tennis it is important that the novice player fully understand and develop the proper technique for serving a ball to an opposing player or court. Basically, such technique requires that, at the instant the ball is in position for service to the opposing court, the serving player smoothly rotate the racquet, using the wrist as a fulcrum, whereby to trace a smooth and continuous arc with the ball rebounding surface or net face of the racquet. Unfortunately, this technique is all too often overlooked by novice players who attempt to anticipate the serve by stroking or pushing the racquet through the ball, rather than rotating the wrist whereby to meet the ball. As a result, the net face of the racquet may become slightly misaligned at the moment of impact with the ball, thereby rebounding the ball off the net face in an uncontrolled manner.

In teaching proper serving techniques, instructors of the game generally employ racquets of conventional design which characteristically exhibit substantial rigidity along the entire length thereof. A novice player using such conventional racquets soon learns that a successful serve can be obtained by compensating for an improper serving stroke, such as by pushing the net face through the ball. At both the player's conscious and subconscious levels, therefore, proper stroking is not emphasized and the player may be caused to develop habits which will later detract from the character and quality of his play at tennis.

In view of the foregoing, it will be appreciated that the need exists to provide a training device which, owing to its unique construction, permits accurate service of a ball only under circumstances where the player properly exercises and executes the fundamental serving techniques, i.e., the smooth arcing of the net face. In this manner proper stroking will be continuously reinforced and the player better able to quickly master the fundamentals of the game.

Therefore, it is a primary object of the present invention to provide an improved racquet construction which will permit accurate service of a ball only upon the exercise of proper stroking techniques.

It is yet another object of the present invention to provide a racquet operable predominantly under the influence of centrifugal force to orient the net face portion thereof into a position which permits a player to control the trajectory of a ball.

And yet another object is to provide a device of simplified construction and adaptable as a training aid for various sports, comprising a minimum number of parts which facilitate maintenance and service at reduced costs.

The foregoing and other objects of the invention will be readily appreciated by reference to the following description of the invention taken together with the accompanying drawings.

SUMMARY OF THE INVENTION

The present invention is directed to a training device particularly adapted for reinforcing proper serving and stroking techniques utilized in various racquet sports. However, the invention hereafter disclosed is equally adaptable as a training device in various other sports where one of the fundamentals of play of said sports includes the meeting of a ball in play by smoothly rotating the device about one's wrist whereby to trace a continuous arc. Therefore, it will be understood that the disclosure which follows is for illustrative purposes only and is not intended to limit the scope of the invention to the particular enumerated examples.

In one embodiment of the present invention adapted as a training aid for racquet sports, and in particular tennis, the invention substantially comprises a conventionally constructed racquet bisected across the handle thereof to form an elongated handle member grippable by a player and a second member which includes a net face or ball rebounding surface. Hinge means are provided for connecting said handle member and said second member for free pivotal movement about an axis transverse to the longitudinal dimension of said handle and generally parallel with said ball rebounding surface so that the head portion of the racquet can freely articulate with respect to the handle portion.

When a player using the device properly executes the preferred stroking technique for serving a ball to an opposing player or court, centrifugal forces acting upon the head portion or second member will cause the latter to align itself with the handle member, thereby permitting the player to controllably meet and rebound the ball to the opposing court.

In order to protect an individual using the device from inadvertent injury, cooperable abutment means are provided on said handle and second members to limit relative pivotal movement thereof to a predetermine range.

Furthermore, so that the device may be utilized in a conventional matter to play various sports, means are also provided for rigidly connecting said handle and second members in substantially longitudinal alignment along the length thereof and generally parallel with said ball rebounding surface.

DETAILED DESCRIPTION OF THE PREFERRED EMBODIMENT

Figure 1:
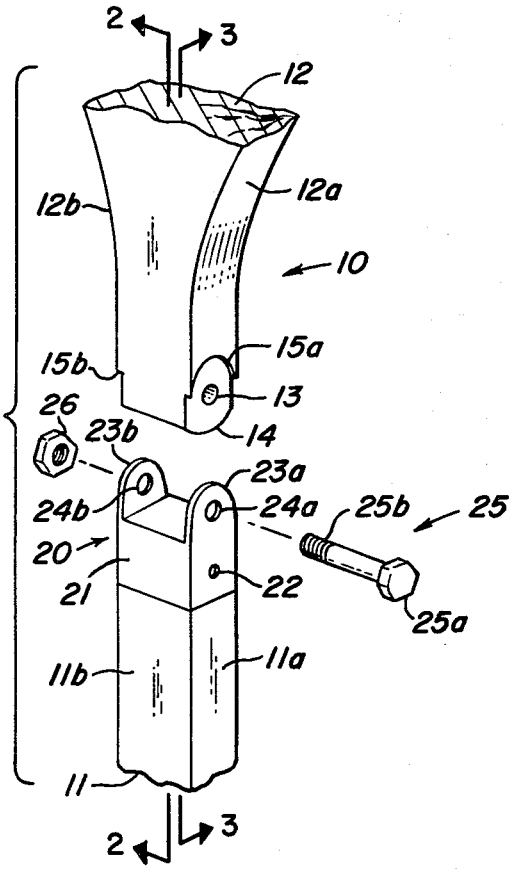
FIG. 1 is a partial perspective exploded view of the preferred embodiment of the present invention.
Figure 2:
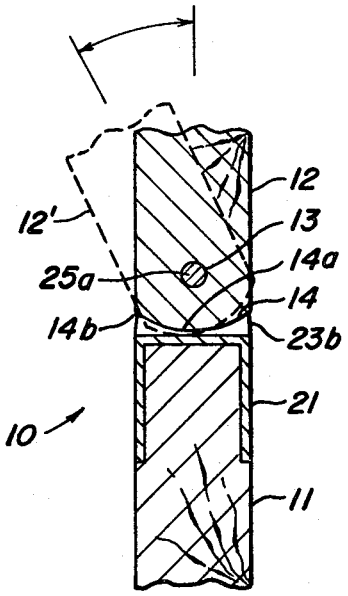
FIG. 2 is a partial cross-sectional view of the embodiment shown in FIG. 1 taken along line 2—2.
Figure 3:
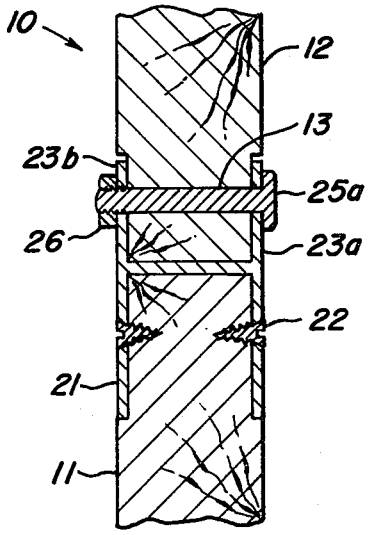
FIG. 3 is a partial cross-sectional view of the embodiment shown in FIG. 1 taken along line 3—3.

For a more complete understanding of the present invention, reference is now made to the accompanying drawings wherein like reference numerals refer to like parts throughout the several views, and wherein FIGS. 1, 2, and 3 are directed to an embodiment of the invention adapted as a training aid for the game of tennis.

More specifically, FIGS. 1, 2, and 3 each show various views of a racquet 10 bisected across the handle thereof whereby to form an elongated handle member 11 grippable at one end (not shown) by a player, and a second member or head portion 12 including a conventional ball rebounding surface or net face (not shown).

Means 20 is provided for connecting members 11 and 12 for free relative pivotal movement about an axis transverse to the longitudinal dimension of said handle and generally parallel with said ball rebounding surface so that said head portion is free to articulate in a pivotal manner with respect to handle member 11.

In the preferred embodiment of the invention as shown by the several figures, means 20 may take the form of hinge means 21 on the end of handle member 11, opposite from said grippable end, and secured thereto by screws 22 or the like. The illustrated hinge means 21 includes a pair of spaced parallel hinge arm members 23*a* and 23*b* disposed opposite one another at substantially the opposite lateral surfaces 11*a* and 11*b* of handle member 11. The hinge arm members 23*a* and 23*b* project from handle member 11 and include apertures 24*a* and 24*b* therethrough, respectively, which are substantially coaxial and receive therein suitable pivot pin means 25. The illustrated pin means comprises a bolt member 25*a* or the like, which is threaded along a portion of its distal end 25*b* and is engaged by threaded means 26, means 26 being in the form of a self-locking nut or the like wellknown to the art.

The head portion or second member 12 is formed with a transverse bore 13 of a size sufficient to receive the pivot pin 25*a* which extends therethrough. Optionally, a conformable hollow sleeve (not shown) may line the interior of bore 13 to minimize deterioration of bore 13 over an extended period of time, as well as to reduce frictional forces between the interior surfaces of bore 13 and pin 25*a*.

So that the lateral surfaces of racquet 10 may present a substantially smooth and finished appearance, head portion or second member 12 may have portions of the edge surfaces 12*a* and 12*b* thereof proximate bore 13 cut away as shown at 15*a* and 15*b* to accommodate hinge arm members 23*a* and 23*b*. Of course, such construction requires the cut away portions 15*a* and 15*b*, shown in FIG. 1, to be configured to ensure that the free pivotal movement of head portion or second member 12 relative to handle 11 is not interfered with by hinge arm members 23*a* and 23*b*.

It will be appreciated that the present invention, as thus far described, permits the free articulation of the head portion of second member 12 relative to the handle member 11 about the axis of pin 25*a*. In order to protect an individual using racquet 10 from inadvertent injury by uncontrolled relative pivotal movement of the racquet members, it is preferred to provide means limiting the range of such pivotal movement. This may be provided by cooperable abutment means on the handle and second members engageable to limit relative pivotal movement thereof to a predetermined range. In the illustrated embodiment the arcuate end surface 14 of head portion or second member 12 is formed, as shown in FIGS. 1 and 2, so that the radial distance from the axis of pin 25*a* to end face 14 increases slightly between the positions 14*a* and 14*b* indicated thereon, so that when the head portion is pivoted to the dotted line position 12' shown in FIG. 2, the surface portion 14*b* engages the adjacent end surface of the hinge member 21, to thereby define the limit of relative pivotal movement in one direction. In a similar manner, the limit of relative pivotal movement in the opposite direction is defined. In the preferred embodiment of the invention it is considered preferable to limit said maximum angle to about $\pm 60°$ on either side of the position in which the head portion and handle are aligned.

Inasmuch as the head portion or second member is permitted to freely articulate relative to the handle member 11, any attempt by a player to control the trajectory of a ball in play by means other than proper stroking techniques will result in the ball rebounding off said net face in an uncontrolled manner. However, under circumstances where the player properly executes the preferred stroking technique, the head portion 12 will be actuated by centrifugal force into alignment with handle 11. In this manner the player will be able to control the ball trajectory only by properly stroking the racquet and, thus, the device as herein disclosed serves as a useful training aid for the continuous reinforcement of proper serving and stroking techniques.

Coming now to FIGS. 4 through 7, inclusive, therein are shown various views of an alternate embodiment of the present invention. While the underlying theory hereinbefore described relating to using the device as a training aid is equally applicable here, the illustrated alternate embodiment represents a further refinement of the inventive concept to permit both a "break-down" capability for the device and the employment of same in conventional racquet sports play.

Figure 4:
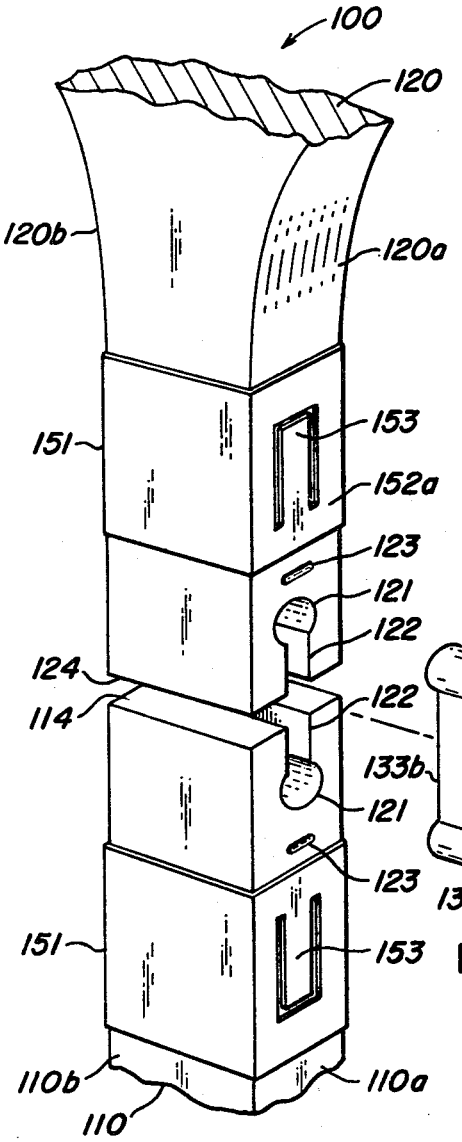
FIG. 4 is a partial perspective exploded view of an alternate embodiment of the present invention.

More specifically, FIG. 4 shown a racquet 100 bisected across the handle thereof whereby to form an elongated handle member 110 grippable at one end (not shown), and a second member or head portion 120 which includes a conventional net face or ball rebounding surface (not shown).

Figure 4A:
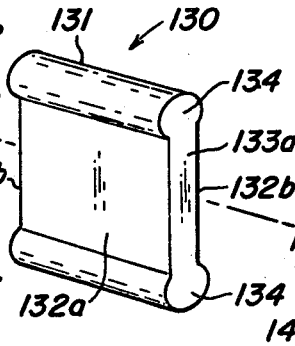
FIG. 4A is a perspective view of means adapted to connect said handle and second members shown in FIG. 4.

Means 130 (FIG. 4A) is provided for connecting members 110 and 120 for free relative pivotal movement about an axis transverse to the longitudinal dimension of said handle and generally parallel with said ball rebounding surface so that said second member or head portion is free to articulate in a pivotal manner relative to member 110.

In the alternative embodiment of the invention means 130 may take the form of a flexible key member 131 having first and second planar surfaces 132*a* and 132*b* substantially parallel to one another. Formed upon opposite ends of key member 131 are integral shoulder means 134 having a lateral axis substantially transverse to the longitudinal dimension of said member and generally parallel to said first and second planar surfaces.

In order to effect the physical connection of key member 131 to members 110 and 120, each of said members is provided with means for cooperably engaging shoulders 134. Briefly, the illustrated means comprises the cooperable combination of a transverse bore 121 and slot 122 disposed through each member 110 and 120 between their respective sidewalls, 110*a*, 110*b*, 120*a*, and 120*b*. Said bores and slots are positioned proximate to, and communicate with, end surfaces 114 and 124 of said handle and second members. As will be noted by reference to FIG. 6, the longitudinal dimension of key member 131 is preferrably at least equal to the longitudinal dimension of said bores and slots combination when end surfaces 114 and 124 are in abutting relationship against one another. Thus, when key member 131 is inserted into, and cooperably engaged by, said shoulder engaging means, head portion or second member 120 is permitted to pivotally articulate about an axis substantially transverse to handle member 110 and generally parallel to said rebounding surface.

Figure 5:
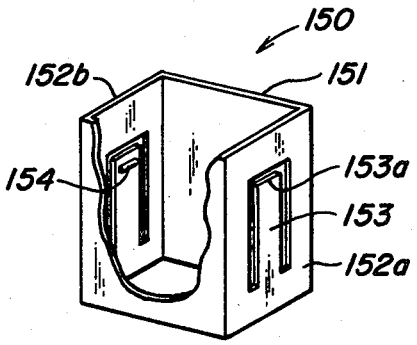
FIG. 5 is a cut-away perspective view of means for detachably securing the connecting means shown in FIGS. 4A and 4B to said handle and second members.

Of course, the illustrated means 130 may be retained in cooperable engagement within bores 121 and slots 122 by the use of adhesive, or the like, applied to shoulders 134. However, because it is preferred to permit the racquet 100 to be brokendown for facilitating the transportation or repair thereof, the embodiment illustrated in FIG. 4 further includes means for detachably securing key member 131 in cooperable engagement with said handle and second members. Referring to FIG. 5, said securement means 150 may be embodied in the form of a hollow sleeve member 151 adapted to be slidably surmounted upon each of said handle and second members. Locking means, such as the illustrated leaf-spring members 153, are provided upon opposite sidewalls 152*a* and 152*b* of member 151 and have a nib 154 or the like proximate the distal end 153*a* thereof engageable with conformable nib recesses 123 provided upon the sidewalls of said handle and second members.

Figure 6:
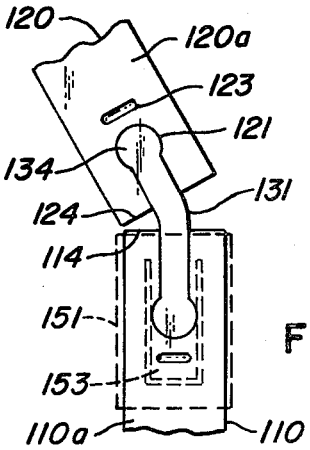
FIG. 6 is a partial side view of the alternate embodiment of the invention shown in FIGS. 4 and 4A illustrating the relative pivotal movement between said handle and second members.

As shown in FIG. 4, sleeve members 151 may be slidably moved to a first open position which permits the interposition of key member 131 between handle member 110 and second member 120. Securement of member 131 therebetween is then facilitated by slidably translating said sleeve members to a first closed position wherein nibs 154 and nib recesses 123 are urged into cooperable engagement. Illustrated by dashed lines in FIG. 6 is the sleeve member 151 surmounting handle member 110 detachably secured in said closed position. The sleeve member 151 surmounting second member 120 is not shown; however, it will be understood that said member would similarly be placed in said first closed position upon said second member and that the positioning of sleeve members 151 in said closed positions would retain key member 131 in place while permitting the pivotal movement of second member 120 relative to handle member 110.

To avoid player injury due to uncontrolled relative pivotal movement between the racquet members, means for limiting the range of such relative pivotal movement are incorporated into the alternate embodiment. This may be provided by cooperable abutment means on the handle and second members engageable to limit the relative pivotal movement thereof to within a predetermined range. In the alternate embodiment shown in FIG. 6, the longitudinal dimension of key member 131 is selected so that the maximum limit of relative pivotal movement in one direction of second member 120 is restricted by the engagement of end surfaces 114 and 124 with each other. In the same manner the limit of relative pivotal movement in the opposite direction is also defined.

In the alternate embodiment of the present invention adapted for use as an articulable training device, it is preferred to construct key member 131 from any durable and flexible material, such as rubber or rubber containing material, which exhibits substantial resistance to all relative movement between the racquet members except said relative pivotal movement. To a certain extent undesired torsional movement of the net face about the longitudinal axis of second member 120 can be controlled by limiting the longitudinal dimension of key member 131 communicating between the end surfaces 114 and 124. Similarly, both the aforementioned torsional movement and centrifugal forces transmitted to key member 131 in the form of tensile stresses, which tensile stresses would otherwise deform said key member and thereby detract from the effectiveness of said pivotal movement limiting means, may be compensated for by employing reinforcing means, such as an integral web of wire, fabric, or the like, into the construction of said key forming material.

Of course, the alternate embodiment of the present invention may be adapted for conventional racquet sports play by forming said key member from a durable and rigid material such as, for example, aluminum, steel, and others well known to the art. Structurally, the only difference between said flexible and rigid key members is that the latter is preferably reduced along its longitudinal dimension whereby insertion of said rigid member into said key member securement means would urge end surfaces 114 and 124 into abutting relationship against each other. Sleeve members 151 would then be secured in said first closed position and the adaptation of racquet 100 for conventional play thereby completed.

It will be appreciated that conventional play subjects the rigid key member to substantial tensile and compressive stresses acting upon said first and second planar surfaces. In order to increase the useful life of said key member by reducing the likelihood of structural failure, it is considered desireable to include means for reducing said forces into the construction thereof.

Figure 4B:
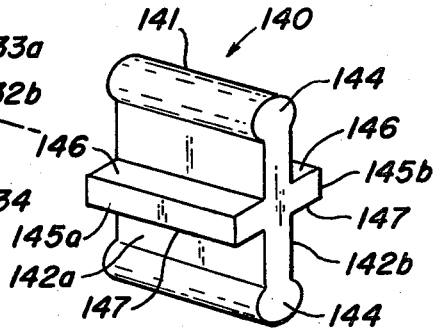
FIG. 4B is a perspective view of the connecting means shown in FIG. 4A modified to incorporate stress reducing means into the construction thereof.

To that end, referring to FIG. 4B, therein is shown an alternate embodiment of a racquet member connecting means 140 comprising a substantially rigid key member 141 including first and second planar surfaces 142*a* and 142*b* substantially parallel to one another. Formed at opposite ends of said key member are integral shoulder means 144 having a lateral axis substantially transverse to the longitudinal dimension of said key member and generally parallel to said first and second planar surfaces. The illustrated key member 141 includes stress reducing means in the form of an integral pair of spaced apart members 145*a* and 145*b* disposed, respectively, upon said first and second planar surfaces transverse to the longitudinal dimension of key member 141 and projecting substantially perpendicular therefrom.

Figure 7:
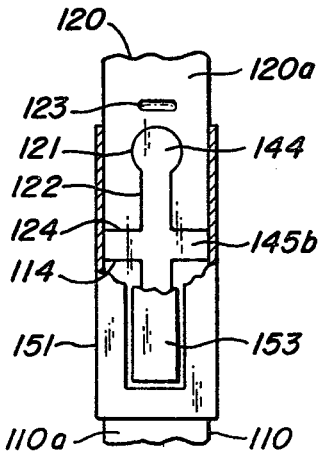
FIG. 7 is a partial, cut-away, side view of the alternate embodiment shown in FIGS. 4 and 4B illustrating the manner by which the racquet may be rigidized to permit normal play therewith.

Each member 145*a* and 145*b* includes spaced apart planar surfaces 146 and 147 parallel to each other and substantially perpendicular to first and second planar surfaces 142*a* and 142*b*. As shown in FIG. 7, surfaces 146 and 147 preferrably are at least of a size sufficient to cooperably abut, respectively, against end surfaces 124 and 114 whereby to maintain handle member 110 and second member 120 in substantially rigid longitudinal alignment along the length thereof. It will be understood that the illustrated form of key member 141 will reduce tensile and compressive stresses by reducing the torque moment acting upon key member 141 due to a ball rebounding from the net face of second member 120. Furthermore, said stresses will also be distributed over a larger area of key member 141, thereby serving to increase the useful life of said key member.

Finally, FIG. 7 also shows a modified form of the sleeve member 151 illustrated in FIG. 5. Briefly, the illustrated sleeve member is characterized in that the longitudinal dimension thereof has been extended so that only one sleeve member is now required in order to secure key member 141 between the handle and second members. The advantage of this modification resides in the fact that the aforementioned forces acting upon key member 141 are now additionally distributed upon the interiorly facing sidewalls of member 151.

While a preferred and alternate embodiment of the invention have been shown and described herein, it is to be appreciated that various changes, rearrangements, and modifications can be made thereto without departing from the scope of the invention as defined in the appended claims. Therefore, to the extent such variant forms of the present invention are possible, such variant forms are considered to be within the scope and essence of the invention.

What is claimed is:

1. A tennis racquet comprising an elongate handle member, a second member having a ball rebounding surface, means connecting said handle and second members for free relative pivotal movement about an axis substantially transverse to the longitudinal dimension of said handle and generally parallel with said ball rebounding surface, said means comprising a flexible key member having shoulder means formed upon opposite ends thereof, each of said handle and second members having a recess extending inwardly from an end face thereof and communicating between opposite side portions of said handle and second members, said recesses being of a shape substantially complemental to said key member so that said key member may be manually, slideably inserted into said recesses for engagement therein, and means for securing said flexible key member within said recesses, said securement means comprising first and second sleeve members slideably surmounted, respectively, upon said handle and second members, said sleeve members each including means for detachably locking said sleeve members upon said handle and second members in first closed positions whereby to secure said flexible key member therebetween.

2. A tennis racquet as set forth in claim 1 further comprising cooperable abutment means on said handle and second members engageable to limit free relative pivotal movement thereof to a predetermined range.

3. A device as set forth in claim 2 wherein said predetermined range extends about $\pm 60°$ in both directions from the position in which said handle and second members are in substantially longitudinal alignment.

* * * * *